US008044874B2

(12) United States Patent
Parsche

(10) Patent No.: US 8,044,874 B2
(45) **Date of Patent: *Oct. 25, 2011**

(54) PLANAR ANTENNA HAVING MULTI-POLARIZATION CAPABILITY AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 360 days.

This patent is subject to a terminal disclaimer.

(21) Appl. No.: 12/388,028

(22) Filed: Feb. 18, 2009

(65) Prior Publication Data

US 2010/0207830 A1 Aug. 19, 2010

(51) Int. Cl.
*H01Q 13/10* (2006.01)

(52) U.S. Cl. ..... 343/770; 343/767

(58) Field of Classification Search ..... 343/700 MS, 343/702, 767, 770

See application file for complete search history.

(56) References Cited

U.S. PATENT DOCUMENTS

| | | | | |
|---|---|---|---|---|
| 1,892,221 | A | 12/1932 | Runge | 343/853 |
| 2,615,134 | A | 10/1952 | Carter | 250/33.67 |
| 2,791,769 | A | 5/1957 | Lindenblad | 343/770 |
| 3,474,452 | A | 10/1969 | Bogner | 343/726 |
| 4,053,769 | A | 10/1977 | Nishikawa et al. | 343/700 |
| 4,160,978 | A | 7/1979 | DuHamel | 343/742 |
| 4,588,993 | A | 5/1986 | Babij et al. | 343/351 |
| 5,216,430 | A * | 6/1993 | Rahm et al. | 343/700 MS |
| 5,675,346 | A | 10/1997 | Nishikawa et al. | 343/700 |
| 5,691,731 | A | 11/1997 | Van Erven | 343/742 |
| 5,769,879 | A | 6/1998 | Richards et al. | 607/101 |
| 5,838,283 | A | 11/1998 | Nakano | 343/741 |
| 5,977,921 | A | 11/1999 | Niccolai et al. | 343/741 |
| 6,208,903 | B1 | 3/2001 | Richards et al. | 607/101 |
| 6,215,402 | B1 | 4/2001 | Rao Kodukula et al. | 340/572.8 |
| 6,292,143 | B1 | 9/2001 | Romanofsky | 343/700 |
| 6,522,302 | B1 | 2/2003 | Iwasaki | 343/726 |
| 7,027,001 | B2 | 4/2006 | Thudor et al. | 343/769 |
| 7,057,558 | B2 * | 6/2006 | Fukushima et al. | 343/700 MS |
| 7,088,298 | B1 | 8/2006 | Chan | 343/727 |

(Continued)

FOREIGN PATENT DOCUMENTS

EP 0516303 12/1992

(Continued)

OTHER PUBLICATIONS

"Wideband Probe-Fed Circularly Polarised Circular Loop Antenna", Laskar et al., 2 pages, Electronics Letters, vol. 41, No. 18, Sep. 1, 2005.

(Continued)

*Primary Examiner* — Jacob Y Choi
*Assistant Examiner* — Shawn Buchanan
(74) *Attorney, Agent, or Firm* — Allen, Dyer, Doppelt, Milbrath & Gilchrist, P.A.

(57) ABSTRACT

The planar antenna apparatus may include a planar, electrically conductive, patch antenna element having a geometric shape defining an outer perimeter, and a pair of spaced apart signal feedpoints along the outer perimeter of the planar, electrically conductive, patch antenna element and separated by a distance of one quarter of the outer perimeter to impart a traveling wave current distribution. The outer perimeter of the planar, electrically conductive, patch antenna element may be equal to about one operating wavelength thereof. The apparatus may provide dual circular or dual linear polarization. The planar patch element may relate to a full wave loop antenna as a compliment.

5 Claims, 5 Drawing Sheets

U.S. PATENT DOCUMENTS

| | | | | |
|---|---|---|---|---|
| 2002/0047802 | A1* | 4/2002 | Voipio | 343/700 MS |
| 2002/0050828 | A1 | 5/2002 | Seward, IV et al. | 324/652 |
| 2004/0125032 | A1* | 7/2004 | Ikuta et al. | 343/702 |
| 2005/0110689 | A1 | 5/2005 | Masutani | 343/700 |
| 2005/0212705 | A1* | 9/2005 | Legay et al. | 343/700 MS |
| 2008/0136720 | A1 | 6/2008 | Parsche et al. | 343/741 |
| 2008/0150819 | A1 | 6/2008 | Uno et al. | 343/770 |
| 2008/0231521 | A1* | 9/2008 | Anguera Pros et al. | 343/702 |
| 2010/0207829 | A1* | 8/2010 | Parsche | 343/732 |

FOREIGN PATENT DOCUMENTS

| | | |
|---|---|---|
| WO | 2007/106975 | 9/2007 |

OTHER PUBLICATIONS

"A Monopole-Fed Circularly Polarized Loop Antenna", Ojiro et al, pp. 810-813, 1998 IEEE.

"Intermediate-Sized Loop Antennas", Jefferies, pp. 1-15, Apr. 27, 2004, available at www.ee.surrey.ac.uk/Personal/D.Jefferies/loop.html.

Bokhari et al., "A small microstrip patch antenna with a convenient tuning option", IEEE Transactions on Antennas and Propagation, vol. 44, No. 11, Jan. 1996, pp. 1521-1528.

Park et al., "A compact circularly polarized subdivided microstrip ptach antenna", IEEE Microwave and Wireless Components Letters, vol. 12, no. 1, Jan. 2002, pp. 18-19.

* cited by examiner

PLANAR ANTENNA HAVING MULTI-POLARIZATION CAPABILITY AND ASSOCIATED METHODS

FIELD OF THE INVENTION

The present invention relates to the field of communications, and, more particularly, to antennas and related methods.

BACKGROUND OF THE INVENTION

It is possible to have dual linear or dual circular polarization channel diversity. That is, a frequency may be reused if one channel is vertically polarized and the other horizontally polarized. Or, a frequency can also be reused if one channel uses right hand circular polarization (RHCP) and the other left hand circular polarization (LHCP). Polarization refers to the orientation of the E field in the radiated wave, and if the E field vector rotates in time, the wave is then said to be rotationally or circularly polarized.

An electromagnetic wave (and radio wave, specifically) has an electric field that varies as a sine wave within a plane coincident with the line of propagation, and the same is true for the magnetic field. The electric and magnetic planes are perpendicular and their intersection is in the line of propagation of the wave. If the electric-field plane does not rotate (about the line of propagation) then the polarization is linear. If, as a function of time, the electric field plane (and therefore the magnetic field plane) rotates, then the polarization is rotational. Rotational polarization is in general elliptical, and if the rotation rate is constant at one complete cycle every wavelength, then the polarization is circular. The polarization of a transmitted radio wave is determined in general by the transmitting antenna (and feed)—by the type of the antenna and its orientation. For example, the monopole antenna and the dipole antenna are two common examples of antennas with linear polarization. A helix antenna is a common example of an antenna with circular polarization, and another example is a crossed array of dipoles fed in quadrature. Linear polarization is usually further characterized as either vertical or horizontal. Circular Polarization is usually further classified as either Right Hand or Left Hand.

The dipole antenna has been perhaps the most widely used of all the antenna types. It is of course possible however to radiate from a conductor which is not constructed in a straight line. Preferred antenna shapes are often Euclidian, being simple geometric shapes known through the ages for their optimization and utility. In general, antennas may be classified with respect to divergence or curl types, corresponding to dipoles and loops, and line and circle structures, as are well established.

Many structures are described as loop antennas, but standard accepted loop antennas are a circle. The resonant loop is a full wave circumference circular conductor, often called a "full wave loop". The typical prior art full wave loop is linearly polarized, having a radiation pattern that is a two petal rose, with two opposed lobes normal to the loop plane, and a gain of about 3.6 dBi. Reflectors are often used with the full wave loop antenna to obtain a unidirectional pattern.

A given antenna shape can be implemented in 3 complimentary forms: panel, slot and skeleton according to Babinet's Principle. For instance, a loop antenna may be a circular metal disc, a circular hole in a thin metal plate, or a circular loop of wire. Thus, a given antenna shape may be reused to fit installation requirements, such as into the metal skin of an aircraft or for free space. Although similar, the complimentary antenna forms may vary in driving impedance and radiation pattern properties, according to Booker's Relation and other rules.

Dual linear polarization (simultaneous vertical and horizontal polarization from the same antenna) has commonly been obtained from crossed dipole antennas. For instance, U.S. Pat. No. 1,892,221, to Runge, proposes a crossed dipole system. Circular polarization in dipoles may be attributed to George Brown (G. H. Brown, "The Turnstile Antenna", Electronics, 15, Apr. 1936). In the dipole turnstile antenna, two dipole antennas are configured in a turnstile X shape, and each dipole is fed in phase quadrature (0, 90 degrees) with respect to the other dipole. Circular polarization results in the broadside/plane normal direction. The dipole turnstile antenna is widely used, but a dual polarized loop antenna could be more desirable however, as full wave loops provide greater gain in smaller area. The gain of full wave loops and half wave dipoles are 3.6 dBi and 2.1 dBi respectively.

U.S. Published Patent Application No. 2008 0136720 entitled "Multiple Polarization Loop Antenna And Associated Methods" to Parsche et al. includes methods for circular polarization in single loop antennas made of wire. A full wave circumference loop is fed in phase quadrature (0°, 90°) using two driving points. Increased gain is provided relative to half wave dipole turnstiles, and in a smaller area.

Notch antennas may comprise notched metal structures and the notch may serve as a driving discontinuity for in situ or free space antennas. For example, notches can form antennas in metal aircraft skins, or they may electrically feed a Euclidian geometric shape. Euclidian geometries (lines, circles, cones, parabolas etc.) are advantaged for antennas. They are known for their optimizations: shortest distance between two points, greatest area for perimeter etc. Radiation properties of notch antennas may be hybrid between that of the driving notch and those of the notched structure.

U.S. Pat. No. 5,977,921 to Niccolai, et al. and entitled "Circular-polarized Two-way Antenna" is directed to an antenna for transmitting and receiving circularly polarized electromagnetic radiation which is configurable to either right-hand or left-hand circular polarization. The antenna has a conductive ground plane and a circular closed conductive loop spaced from the plane, i.e., no discontinuities exist in the circular loop structure. A signal transmission line is electrically coupled to the loop at a first point and a probe is electrically coupled to the loop at a spaced-apart second point. This antenna requires a ground plane and includes a parallel feed structure, such that the RF potentials are applied between the loop and the ground plane. The "loop" and the ground plane are actually dipole half elements to each other.

U.S. Pat. No. 5,838,283 to Nakano and entitled "Loop Antenna for Radiating Circularly Polarized Waves" is directed to a loop antenna for a circularly polarized wave. Driving power fed may be conveyed to a feeding point via an internal coaxial line and a feeder conductor passes through an I-shaped conductor to a C-type loop element disposed in spaced facing relation to a ground plane. By the action of a cutoff part formed on the C-type loop element, the C-type loop element radiates a circularly polarized wave. Dual circular polarization is not however provided.

However, there is still a need for a relatively small planar antenna for operation with any polarization including linear, circular, dual linear and dual circular polarizations.

SUMMARY OF THE INVENTION

In view of the foregoing background, it is therefore an object of the present invention to provide a planar antenna having versatile polarization capabilities, such as linear, circular, dual linear and dual circular polarization capabilities, for example.

This and other objects, features, and advantages in accordance with the present invention are provided by a planar antenna apparatus including a planar, electrically conductive, patch antenna element having a geometric shape defining an outer perimeter, and a pair of spaced apart signal feedpoints along the outer perimeter of the antenna element and separated by a distance of one quarter of the outer perimeter to impart a traveling wave current distribution. The outer perimeter of the planar, electrically conductive, patch antenna element may be equal to about one operating wavelength thereof. Such a relatively small and inexpensive antenna device has versatile polarization capabilities and includes enhanced gain for the size.

A feed structure may be coupled to the signal feedpoints to drive the planar, electrically conductive, patch antenna element with a phase input to provide at least one of linear, circular, dual linear and dual circular polarizations. The planar, electrically conductive, patch antenna element may be devoid of a ground plane adjacent thereto, and the geometric shape of the planar, electrically conductive, patch antenna element may be a circle or a polygon such as a square.

Each of the signal feedpoints may comprise a notch in the planar, electrically conductive, patch antenna element. Each of the notches may open outwardly to the outer perimeter, and each of the notches may extend inwardly toward a center of the planar, electrically conductive, patch antenna element. Each of the notches may extend inwardly and perpendicular to a respective tangent line of the outer perimeter.

A method aspect is directed to making a planar antenna apparatus including providing a planar, electrically conductive, patch antenna element having a geometric shape defining an outer perimeter, and forming a pair of spaced apart signal feedpoints along the outer perimeter of the planar, electrically conductive, patch antenna element and separated by a distance of one quarter of the outer perimeter to impart a traveling wave current distribution. The outer perimeter of the planar, electrically conductive, patch antenna element may be equal to about one operating wavelength thereof. The method may include coupling a feed structure to the signal feedpoints to drive the planar, electrically conductive, patch antenna element with a phase input to provide at least one of linear, circular, dual linear and dual circular polarizations.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and completer and will fully convey the scope of the invention to those skilled in the art. Like numbers refer to like elements throughout, and prime notation is used to indicate similar elements in alternative embodiments.

Figure 1:
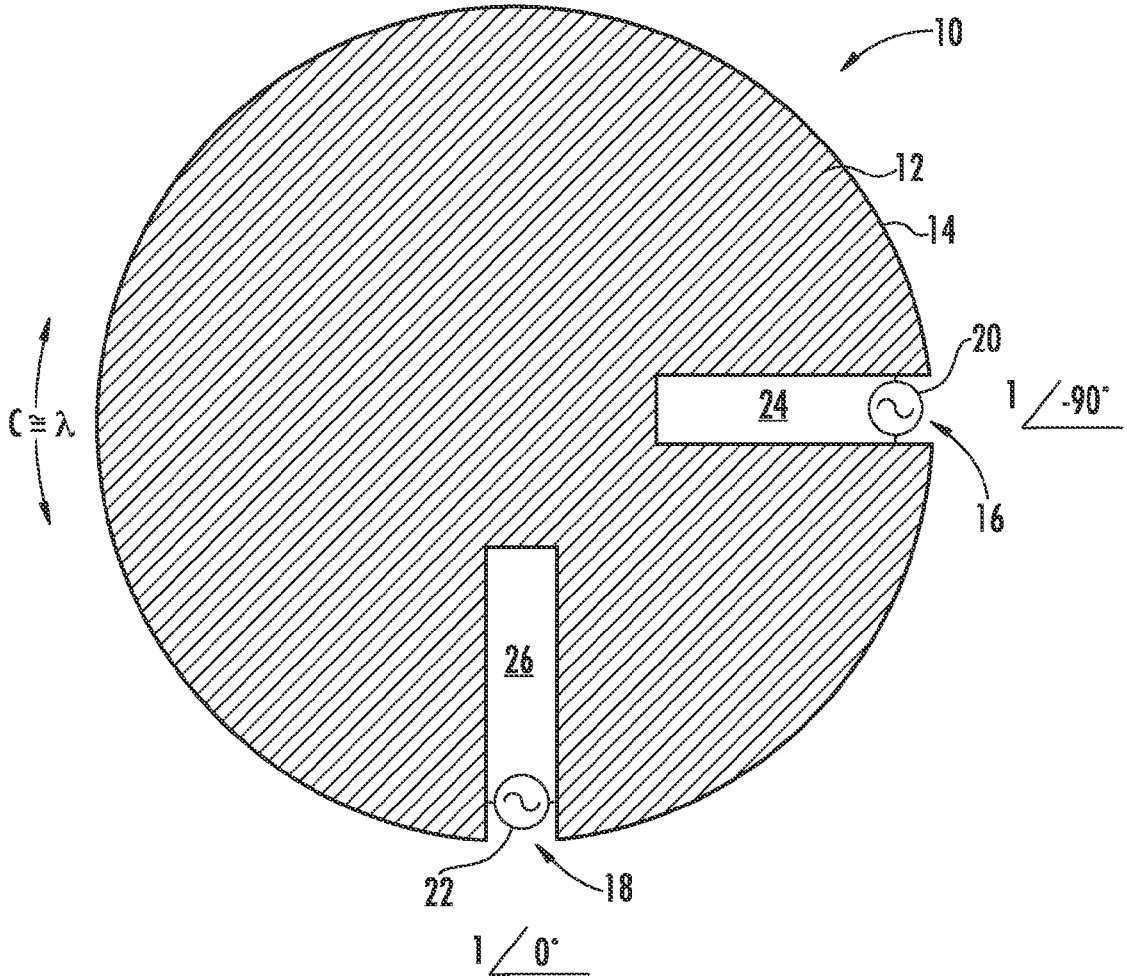
FIG. 1 is a schematic diagram illustrating an embodiment of a planar antenna apparatus according to the present invention.

Referring initially to FIG. 1, an embodiment of an antenna apparatus 10 with linear, circular, dual linear and dual circular polarization capabilities will be described. The antenna apparatus 10 may be substantially flat, e.g. for use on a surface such as the roof of a vehicle, and may be relatively small with the most gain for the size. The antenna apparatus 10 may be used for personal communications such as mobile telephones, and/or satellite communications such as GPS navigation and Satellite Digital Audio Radio Service (SDARS), for example.

The planar antenna apparatus 10 includes a planar, electrically conductive, patch antenna element 12 having a geometric shape defining an outer perimeter 14. The patch antenna element 12 may be formed as a conductive layer on printed wiring board (PWB) or from a stamped metal sheet such as 0.010" brass, for example. In this embodiment, the shape of the planar, electrically conductive, patch antenna element 12 is a circle, and the outer perimeter 14 is the circumference. The diameter may be 0.33 wavelengths in air and the circumference 1.04 wavelengths in air at the operating frequency. For example, at a frequency of 1000 MHz, patch antenna element 12 may be 3.9 inches diameter and 12.3 inches in circumference.

A pair of spaced apart signal feedpoints 16, 18 are along the outer perimeter 14 of the planar, electrically conductive, patch antenna element 12 and separated by a distance of one quarter of the outer perimeter. Illustratively in FIG. 1, signal sources 20, 22 are shown as being connected at the signal feedpoints 16, 18, and such signal sources 20, 22 may of course be coupled to signal feedpoints 16, 18 by a coaxial transmission line (not shown) as is common.

As a circular planar, electrically conductive, patch antenna element 12, the separation distance of the signal feedpoints 16, 18 is about 90 degrees along the circumference. The separation of the signal feedpoints 16, 18, and the phasing thereof, allows a feed structure to impart a traveling wave current distribution in the planar, electrically conductive, patch antenna element 12, as discussed in further detail below. The outer perimeter 14 of the planar, electrically conductive, patch antenna element 12 is equal to about one operating wavelength thereof.

The planar, electrically conductive, patch antenna element 12 may be devoid of a ground plane adjacent thereto. Such a relatively small and inexpensive antenna apparatus 10 has versatile polarization capabilities and includes enhanced gain for the size. Each of the signal feedpoints 16, 18 illustratively comprises a notch 24, 26 in the planar, electrically conductive, patch antenna element 12. Each of the notches 24, 26 opens outwardly to the outer perimeter 14, and each of the notches extends inwardly toward a center of the planar, electrically conductive, patch antenna element 12. The notches may be ¼ wave deep for resonance and cross at the center of patch antenna forming an "X", and each of the notches 24, 26 illustratively extends inwardly and perpendicular to a respective tangent line of the outer perimeter 14. Shunt feeds (not shown) such as a gamma match may be used to provide signal feedpoints 16, 18 as may be familiar to those in the art with respect to yagi uda antennas.

FIG. 1 depicts the signal feedpoints 16, 18 to be excited at equal amplitude and −90 degrees phase shift relative each other, e.g. signal source 22 is applying 1 volt at 0 degrees phase to the patch antenna element 12 and signal source 20 is applying 1 volt at −90 degrees phase. The excitation in the antenna of FIG. 1 causes the patch antenna element 12 to radiate circular polarization in the broadside directions (e.g. normal to the antenna plane). Referring again to FIG. 1, right hand sense circular polarization is rendered upwards from the page with the phase shown. If the phasing is reversed left hand circular polarization is radiated upwards out of the page. Polarization sense is as defined in FIG. 40, illustration of sense of rotation, IEEE Standard 145-1979, "Standard Test Procedures For Antennas", Institute Of Electrical and Electronics Engineers, NY, N.Y.

Dual linear polarization will now be described. Referring again to FIG. 1, when signal feedpoints 16, 18 are excited at equal amplitude and 0 degrees phase shift relative each other (not shown), e.g. if signal source 22 applies 1 volt at 0 degrees phase to the patch antenna element 12 and signal source 20 also applies 1 volt at 0 degrees phase, linear polarization is produced broadside to the antenna plane. The horizontally polarized component is referred electrically to signal source 22 and the vertically polarized component is referred electrically to signal source 20. Thus, equal amplitude and equal phase excitation at feedpoints 22, 18 produces dual linear polarization vertical and horizontal.

Figure 2:
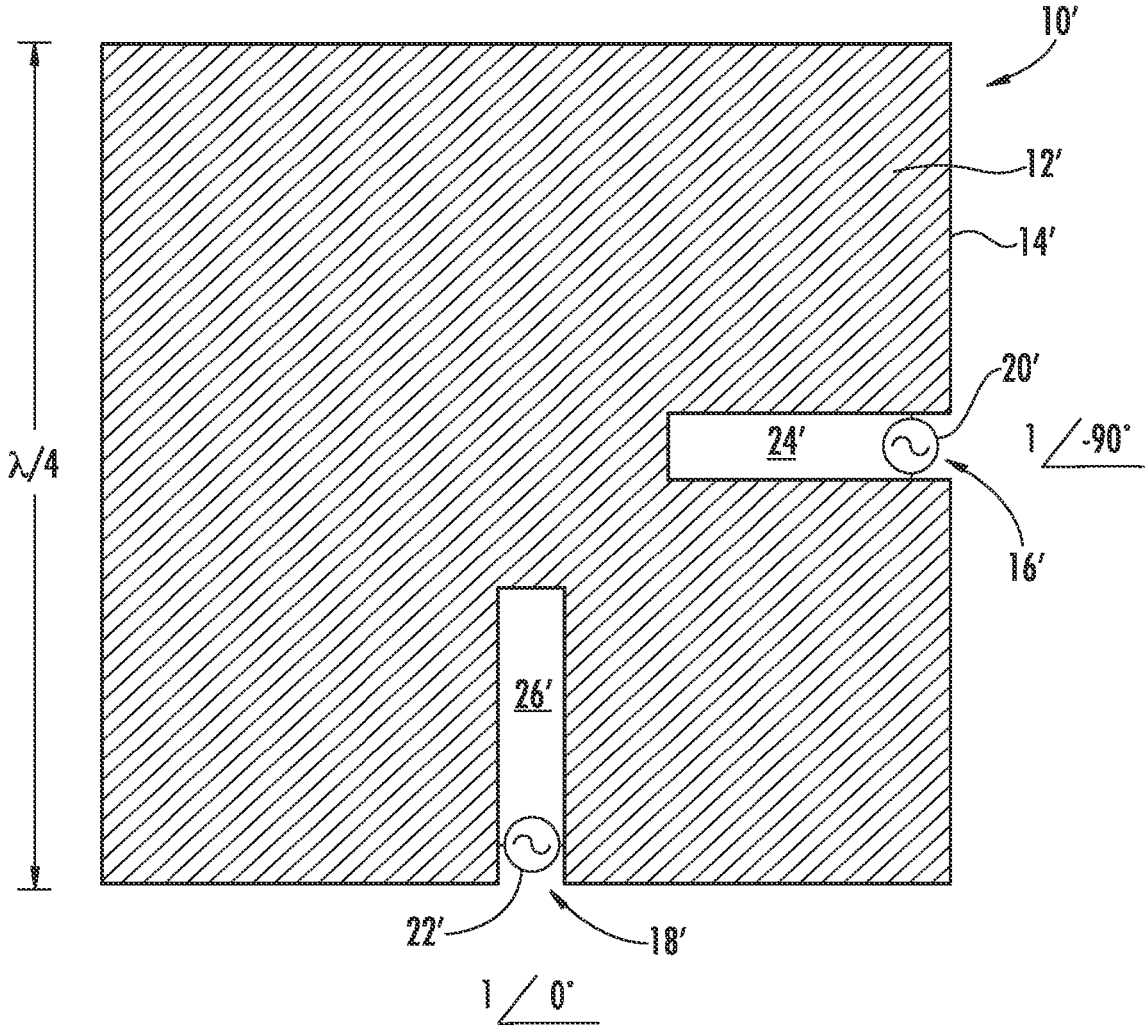
FIG. 2 is a schematic diagram illustrating another embodiment of a planar antenna apparatus according to the present invention.

Referring to FIG. 2, another embodiment of the planar antenna apparatus 10' will be described. Here, the planar, electrically conductive, patch antenna element 12' has a polygonal shape, e.g. a square. In the example, since the shape of the planar, electrically conductive, patch antenna element 12' is a square, and the outer perimeter 14' is equal to about one operating wavelength, then each side is equal to about one quarter of the operating wavelength. Also, the signal feedpoints 16', 18' are separated by a distance of one quarter of the outer perimeter 14' which is about one quarter of the operating wavelength. Again, illustratively in FIG. 2, signal sources 20', 22' are shown as being connected at the signal feedpoints 16', 18'.

The feed structure for the present invention may be coupled to the signal feedpoints 16, 18 to drive the planar, electrically conductive, patch antenna element 12 with a phase input to provide at least one of linear, circular, dual linear and dual circular polarizations.

Figure 3:
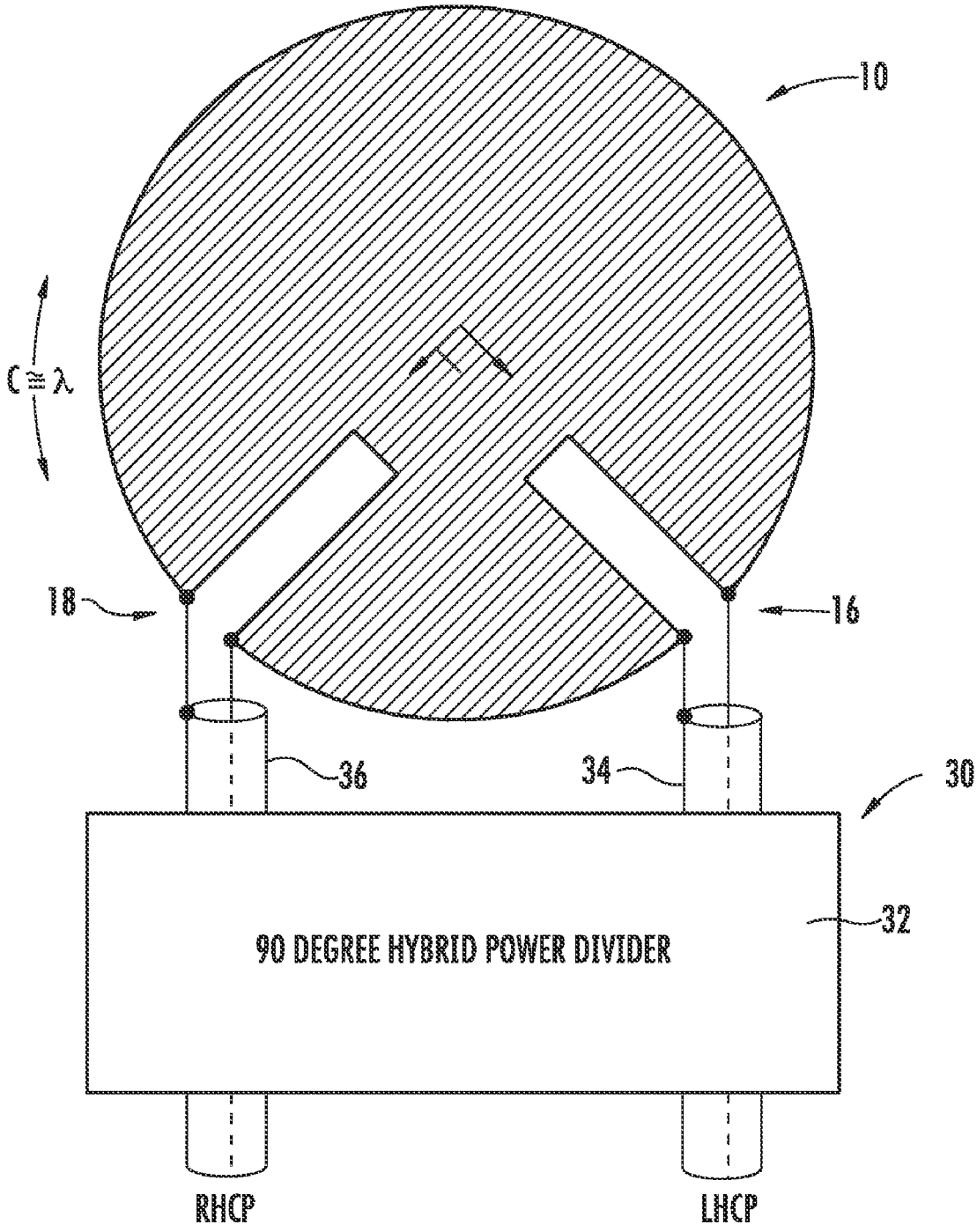
FIG. 3 is a schematic diagram illustrating another embodiment of a planar antenna apparatus including a dual circularly polarized feed structure according to the present invention.

The feed structure 30, as illustrated in FIG. 3, illustratively includes a 90-degree hybrid power divider 32 and associated feed network having, for example, a plurality of coaxial cables 34, 36 connecting the power divider to the signal feedpoints 16, 18. Such a hybrid feed structure 30 can drive the patch antenna element 12 of the planar antenna apparatus 10 with the appropriate phase inputs for circular polarization such as right-hand circular polarization or left-hand circular polarization, and/or dual circular polarization, i.e. both right-hand and left-hand polarization simultaneously. Isolation between the right and left ports may be 20 to 30 dB in practice.

Figure 4:
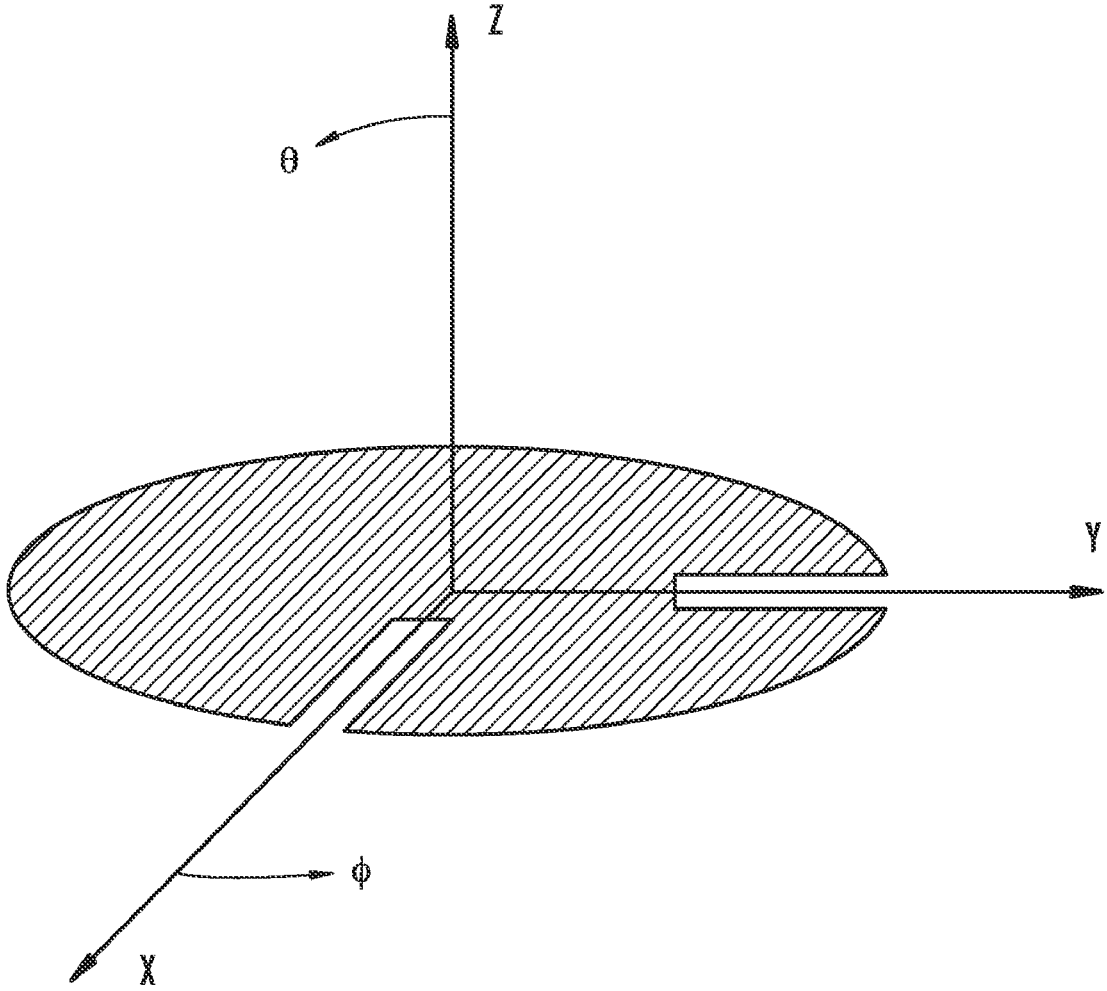
FIG. 4 depicts the antenna of FIG. 1 in a standard radiation pattern coordinate system.
Figure 5:
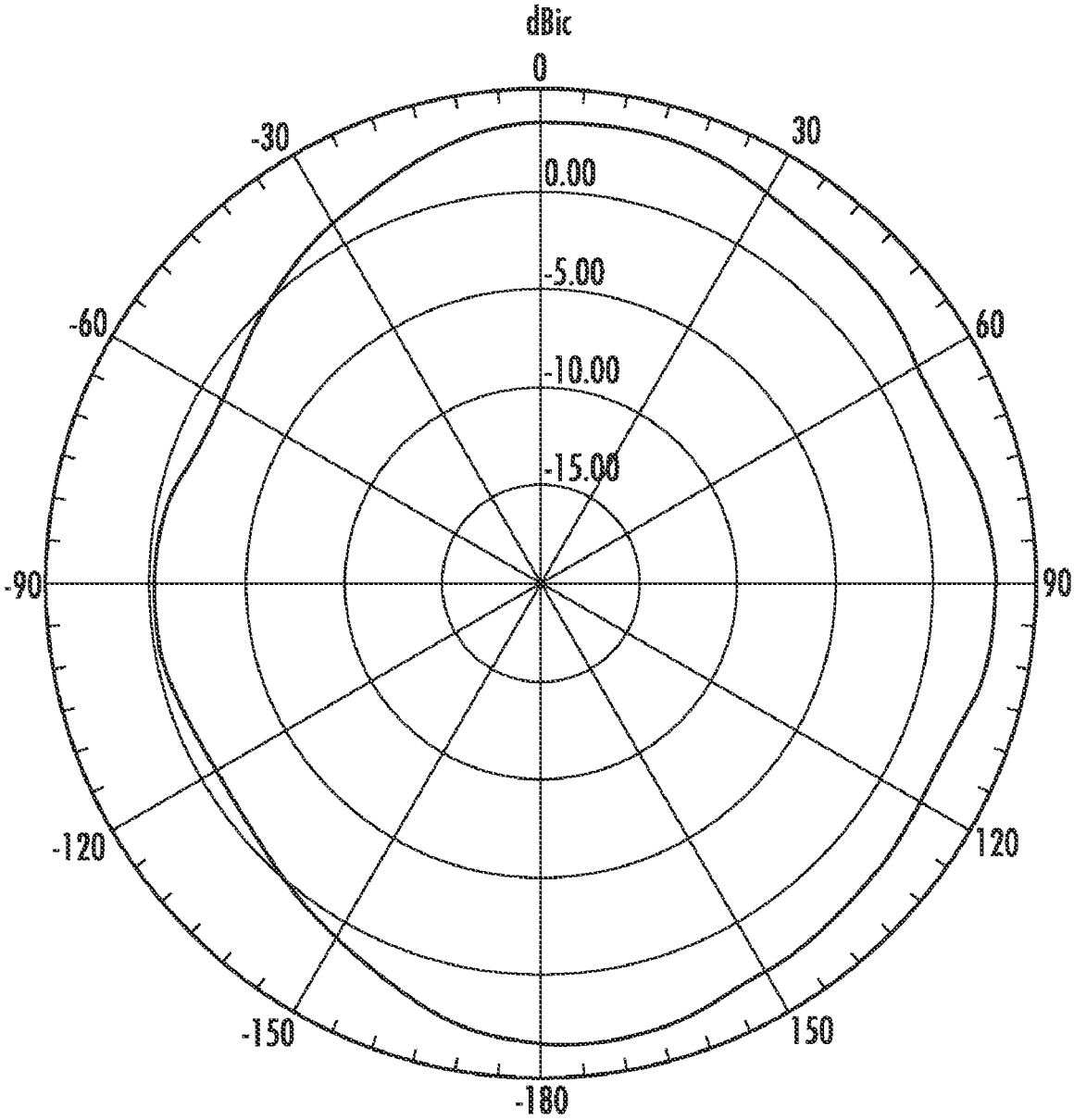
FIG. 5 is a graph illustrating an example of the XZ plane elevation cut far field radiation pattern of the antenna of FIG. 1.

Referring to FIGS. 4 and 5, the radiation pattern coordinate system and an XZ elevation plane radiation pattern cut of the present invention are respectively presented. The radiation pattern is for the example of the FIG. 1 embodiment, and as can be appreciated, the pattern peak amplitude is approximately broadside to the antenna plane. The gain is 3.6 dBic, e.g. 3.6 decibels with respect to isotropic and for circular polarization.

The radiation pattern was calculated by finite element numerical electromagnetic modeling in the Ansoft High Frequency Structure Simulator (HFSS) code, by Ansoft Corporation, Pittsburgh, Pa. The present invention is primarily intended for directive pattern requirements using the pattern maxima broadside to the antenna plane, and a plane reflector can be added to form a unidirectional antenna beam (not shown). A ¼ wave plane reflector at ¼ wave spacing from the patch antenna element 12 may render 8.6 dBic gain. A similarly situated dipole turnstile plus reflector may provide about 7.2 dBic of gain, giving the present invention a 1.4 dB advantage. The present invention is slightly smaller in size as well.

In prototypes of the present invention, the 3 dB gain bandwidth was 25.1 percent and the 2:1 VSWR bandwidth 8.8 percent. The bandwidth was for a quadrature hybrid feed embodiment and bandwidth may vary with the type of feeding apparatus used. A reactive T or Wilkinson type power divider may of course be used for single sense circular polarization, with an additional 90 degree transmission line length in one leg of the feed harness.

In the linear polarization embodiments of the antenna apparatus 10 a standing wave sinusoidal current distribution is imparted near and along the perimeter patch antenna element 12. Circular polarized embodiments of the present invention operate with a traveling wave distribution caused by the superposition of orthogonal excitations: sine and cosine potentials at signal feedpoints 16, 18. As signal feedpoints 16, 18 are located ¼ wavelength apart on a 1 wavelength circle hybrid isolation exists between signal feedpoints 16, 18, e.g. a hybrid coupler of the branchline type is formed in situ, albeit without the unused branches. In a traveling wave current distribution current amplitude is constant with angular position and phase increases linearly with angular position around the antenna aperture. The far field radiation pattern may be obtained from the Fourier transform of the current distribution present on the patch antenna element 12.

The driving point resistance at resonance at the periphery of a resonant driving notch 24, 26 may be calculated by the common form of Bookers Relation:

$$Z_c Z_s = \eta^2/4$$

Such that:

$$Z_s = (377^2/4)(1/136) = 261 \text{ Ohms}$$

Where:

$Z_c$=Impedance of compliment antenna≅135 Ohms for full wave wire loop $Z_s$=Impedance of slot compliment antenna $\eta$=Characteristic impedance of free space≅120π.

As current radio art may favor a lower, e.g. 50 Ohm feedpoint impedance, the location of signal sources 20, 22 may be adjusted radially inward along the notches 24, 26 to obtain lower resistances. In prototypes of the present invention 50 Ohms resistance was obtained along the notches at about 0.10 wavelengths in from the antenna perimeter and the notches 24, 26 were ¼ wavelength deep. Notches 20, 22 may be oriented circumferentially rather than radially, or meandered as well for compactness.

A method aspect is directed to making a planar antenna apparatus 10 including providing a planar, electrically conductive, patch antenna element 12 having a geometric shape, e.g. a circle or polygon, defining an outer perimeter 14, and forming a pair of spaced apart signal feedpoints 16, 18 along the outer perimeter of the planar, electrically conductive, patch antenna element and separated by a distance of one quarter of the outer perimeter to impart a traveling wave current distribution. The outer perimeter 14 of the planar, electrically conductive, patch antenna element 12 is equal to about one operating wavelength thereof. The method may include coupling a feed structure 30, 30' to the signal feedpoints 16, 18 to drive the planar, electrically conductive, patch antenna element 12 with a phase input to provide at least one of linear, circular, dual linear and dual circular polarizations.

Thus, a panel compliment to the full wave loop antenna is also included. The invention may provide capability for linear, circular, dual linear or dual circular polarization and with sufficient port to port isolation for multiplex communications. The invention is advantaged relative to the dipole turnstile as it may render greater gain for size.

Other features and advantages relating to the embodiments disclosed herein are found in co-pending patent application entitled, PLANAR SLOT ANTENNA HAVING MULTI-POLARIZATION CAPABILITY AND ASSOCIATED METHODS, Ser. No. 12/388,004 which is filed on the same date and by the same assignee and inventor, the disclosure of which is hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A planar antenna apparatus comprising:

a planar, electrically conductive, patch antenna element having a geometric shape defining an outer perimeter and being devoid of a ground plane adjacent thereto; and a pair of spaced apart signal feedpoints along the outer perimeter of the planar, electrically conductive, patch antenna element and separated by a distance of one quarter of the outer perimeter and configured to impart a traveling wave current distribution;

each of the signal feedpoints defining a discontinuity and comprising a notch extending inwardly from the outer perimeter toward a center of the planar, electrically conductive, patch antenna element;

the outer perimeter of the planar, electrically conductive, patch antenna element being equal to about one operating wavelength thereof;

a feed structure coupled to the signal feedpoints to drive the planar, electrically conductive, patch antenna element with a phase input to provide at least one of linear, circular, dual linear and dual circular polarizations.

2. The planar antenna apparatus according to claim 1, wherein the geometric shape of the planar, electrically conductive, patch antenna element comprises a polygon.

3. A planar antenna apparatus comprising:

a planar, electrically conductive, patch antenna element having a circular shape defining an outer circumference being equal to about one operating wavelength of the planar, electrically conductive, patch antenna element and being devoid of a ground plane adjacent thereto;

a pair of spaced apart signal feedpoints along the outer circumference of the planar, electrically conductive, patch antenna element and separated by a distance of one quarter of the outer circumference;

each of the signal feedpoints defining a discontinuity and comprising a notch extending inwardly from the outer perimeter toward a center of the planar, electrically conductive, patch antenna element; and a feed structure coupled to the signal feedpoints to drive the planar, electrically conductive, patch antenna element with a phase input to provide at least one of linear, circular, dual linear and dual circular polarizations.

4. A method of making a planar antenna apparatus comprising:

providing a planar, electrically conductive, patch antenna element having a geometric shape defining an outer perimeter and being devoid of a ground plane adjacent thereto;

forming a pair of spaced apart signal feedpoints along the outer perimeter of the planar, electrically conductive, patch antenna element and separated by a distance of one quarter of the outer perimeter to impart a traveling wave current distribution;

each of the signal feedpoints defining a discontinuity and comprising a notch extending inwardly from the outer perimeter toward a center of the planar, electrically conductive, patch antenna element;

the outer perimeter of the planar, electrically conductive, patch antenna element being equal to about one operating wavelength thereof; and coupling a feed structure to the signal feedpoints to drive the planar, electrically conductive, patch antenna element with a phase input to provide at least one of linear, circular, dual linear and dual circular polarizations.

5. The method according to claim 4, wherein providing comprises providing the planar, electrically conductive, patch antenna element with a circular geometric shape.

* * * * *